US006126276A

United States Patent [19]

Davis et al.

[11] Patent Number: 6,126,276

[45] Date of Patent: Oct. 3, 2000

[54] FLUID JET PRINTHEAD WITH INTEGRATED HEAT-SINK

[75] Inventors: Colin C. Davis; Naoto Kawamura; Timothy Beerling; David R. Thomas; William R. Knight; David Waller; Richard Seaver, all of Corvallis, Oreg.

[73] Assignee: Hewlett-Packard Company, Palo Alto, Calif.

[21] Appl. No.: 09/033,504

[22] Filed: Mar. 2, 1998

[51] Int. Cl.[7] ..... B47J 2/05

[52] U.S. Cl. ..... 347/65

[58] Field of Search ..... 347/65, 61, 62, 347/63, 64, 66, 67

[56] References Cited

U.S. PATENT DOCUMENTS

| | | | |
|---|---|---|---|
| 5,159,353 | 10/1992 | Fasen et al. | 346/140 R |
| 5,665,249 | 9/1997 | Burke et al. | 216/2 |
| 5,710,070 | 1/1998 | Chan | 438/21 |
| 5,774,148 | 6/1998 | Cornell et al. | 347/59 |
| 5,783,474 | 7/1998 | Ajit | 438/279 |
| 5,841,452 | 11/1998 | Silverbrook | 347/47 |
| 5,850,241 | 12/1998 | Silverbrook | 347/54 |
| 5,900,894 | 5/1999 | Koizumi et al. | 347/65 |

*Primary Examiner*—Richard Moses

*Attorney, Agent, or Firm*—Timothy F. Meyers; Raymond A. Jenski

[57] ABSTRACT

A printhead used to eject fluid onto a recording medium has an integrated heat-sink which is used to cool the energy dissipation elements used to propel the fluid from the printhead. The printhead is comprised of a semiconductor substrate that has been processed with thin-film layers. On top of the thin-film layers is an orifice layer that has a pattern of orifices. Fluid feed channels, on the side of the printhead opposite the orifice, supply fluid to the pattern of orifices. Within the thin-film layers are energy dissipating elements which are used to transfer energy to the fluid thereby ejecting fluid from the orifice. The fluid is transferred to the orifice opening through fluid feed slots formed in the thin-film layer adjacent to the energy dissipation elements which is exposed in the fluid feed channel. An integrated heat-sink is attached to the energy dissipation elements to remove heat to the semiconductor substrate and the fluid supply in the fluid feed channel.

44 Claims, 18 Drawing Sheets

FLUID JET PRINTHEAD WITH INTEGRATED HEAT-SINK

BACKGROUND OF THE INVENTION

This invention generally relates to thermal inkjet printing. More particularly, this invention relates to the apparatus and process of manufacturing a heat-sink used to cool a resistor or other energy dissipation device used to eject fluid from a fully integrated fluid jet printhead.

Inkjet printers or plotters typically have a printhead mounted on a carriage that traverses back and forth across the width of the paper or other medium feeding through the printer or plotter. Ink (or other fluid) filled channels feed a set of orifices on the printhead surface with ink from reservoir ink source. Energy, applied individually to addressable resistors or other energy dissipating element such as a piezoelectric actuator, transfers energy to the ink within the orifices causing the ink to bubble and thus eject ink out of the orifice towards the paper. As the ink is ejected, the bubble collapses and more ink fills the channels from the reservoir, allowing for repetition of the ink ejection.

Customer demands and competitive pressure continue to drive the need for faster printing and higher resolution. Therefore, there is a strong desire to increase the repetition rate at which the ink ejects from the printhead. Increasing the repetition rate requires that more energy be applied to the resistors in the printhead, thereby causing the printhead to become hotter. If the printhead becomes too hot, the ink will not be ejected from the printhead properly or may misfire causing poor print quality. In addition, the printhead may quit functioning, as it is possible to blow a resistor in the printhead similar to blowing a fuse when a circuit overloads. This type of failure creates a terrible inconvenience to the user as the ink cartridge would have to be replaced. Therefore, it is very important to remove heat generated by the resistor more efficiently.

Another problem, which works against cooling the resistor, is the development of an efficient path to move ink from the reservoir of ink to the resistor in the printhead. This path supports the quick refilling of the orifice after the ink ejects onto the paper. Innovative methods of providing this efficient ink path have unfortunately also reduced the amount of material behind the resistor that in the past was able to conduct the residual heat. Thus the technique, which increases the ink flow to increase the repetition rate, is working against the need to cool the resistor to increase the repetition rate.

Yet another factor, which works against cooling the resistor, is the pursuit of higher print densities in order to have higher resolution and the reproduction of photographic quality prints. As the resolution increases, the amount of ink ejected needs to be reduced per orifice and the adjacent orifices moved closer together. This increase in density means that more energy is going to be expended in a smaller area, thus reducing the amount of space and mass required to move the residual heat away.

Since faster printing, higher print density and resistor cooling are all required, a means for resistor cooling is needed that is compatible with the new efficient ink path and higher density of orifices.

SUMMARY OF THE INVENTION

An integrated heat-sink is used to cool the energy dissipation elements that are used to propel the fluid from a printhead onto a recording medium. The printhead is comprised of a semiconductor substrate that has been processed to create a stack of thin-film layers. On top of the stack of thin-film layers is an orifice layer that has a pattern of orifices. Fluid feed channels, on the side of the printhead opposite the orifice, supply fluid to the pattern of orifices. Within the stack of thin-film layers are energy dissipating elements which are used to transfer energy to the fluid thereby ejecting the fluid from the orifice. The fluid is transferred to the orifice opening through fluid feed slots formed in the thin-film layers adjacent to the energy dissipation elements. The fluid feed slots are exposed in the fluid feed channel. The integrated heat-sink is attached to the energy dissipation elements to couple heat to the semiconductor substrate and the fluid supply in the fluid feed channels.

DETAILED DESCRIPTION OF THE PREFERRED AND ALTERNATE EMBODIMENTS

Figure 1:
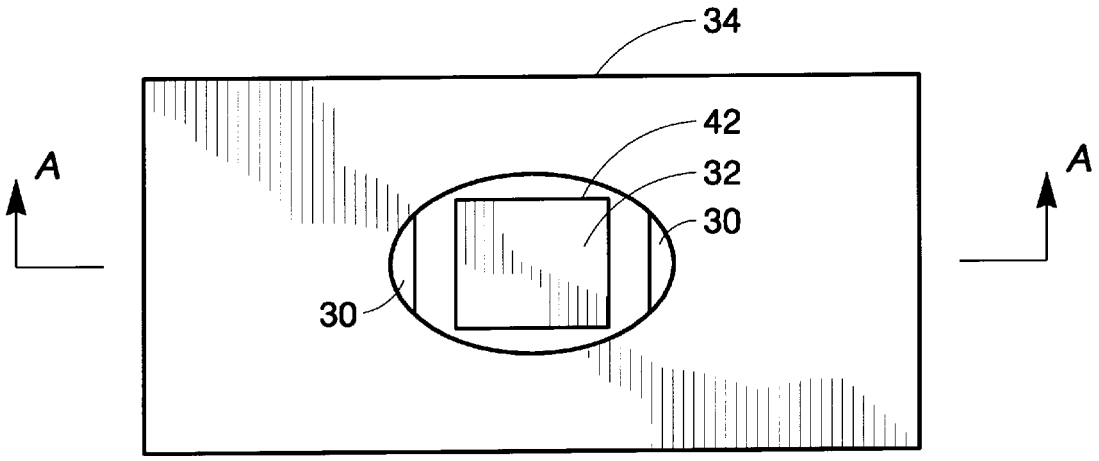
FIG. 1 is a top view of a single orifice of a fully integrated thermal (FIT) fluid printhead architecture.
Figure 2:
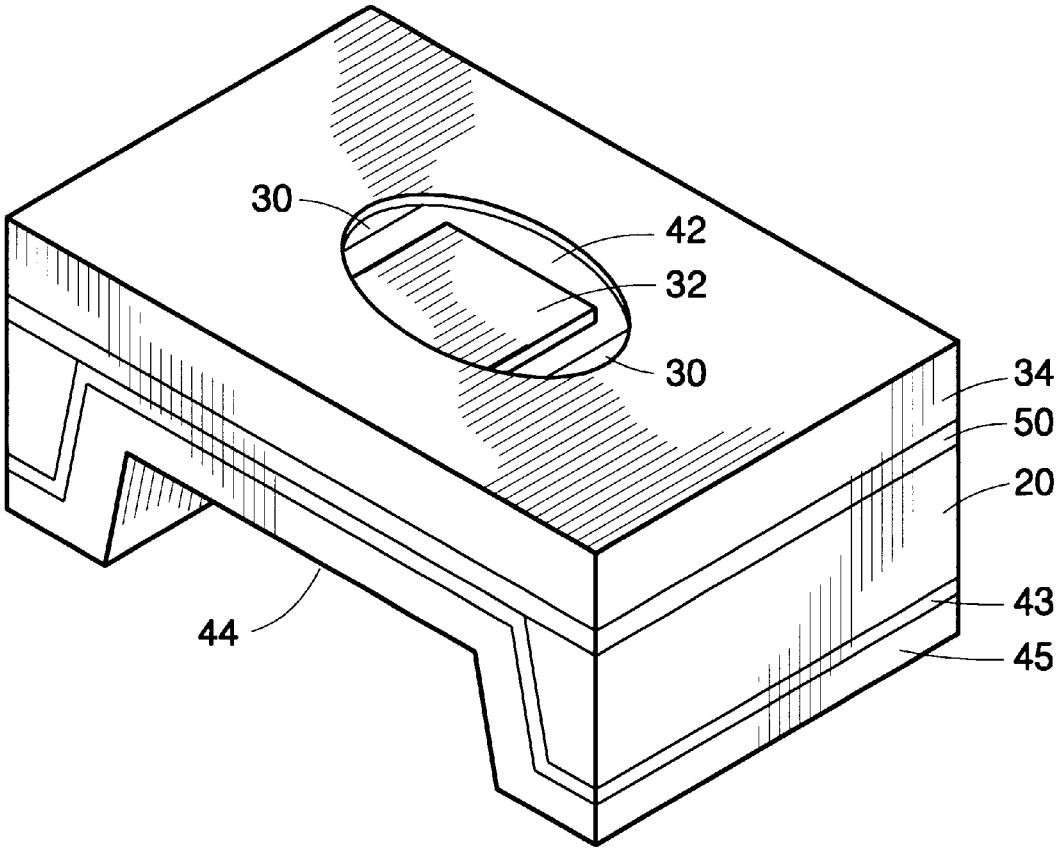
FIG. 2A is an isometric cross sectional view of a single orifice of a FIT fluid printhead showing the preferred embodiment of the integrated heat-sink.

The fully integrated thermal (FIT) fluid-jet architecture as shown in FIG. 1 and FIG. 2 has an inherent thermal limitation. This limitation arises from the removal of semiconductor material to form a fluid feed channel 44 beneath the energy dissipation element 32 (typically a resistor integrated in a stack of thin-film layers 50). Previous architectures for printheads had semiconductor material beneath the resistors, thereby enabling heat to be effectively coupled to the surrounding bulk semiconductor substrate 20. In FIT, a fluid, such as ink, is exposed to the stack of thin-film layers 50. Since the fluid usually consists of a large portion of water and it has a lower thermal diffusivity than the semiconductor, the FIT architecture has a less effective heat path than before. Simulation and empirical testing have shown that the addition of a heat-sink attached to the stack of thin-film layers 50 and the semiconductor material adjacent to the fluid feed channels 44 allows residual heat to escape between firings of fluid from the orifices 42.

It is important that the process used to create the heat-sink be compatible with the existing processes used to create the FIT printhead. The use of compatible processes allows for faster development times, less tooling, minimal interim steps, and higher yields.

The invention as seen in FIG. 2 essentially comprises forming a integrated heat-sink (shown here as metal layer 45 with adhesion layer 43), or a plurality of integrated heat-sinks, to a stack of thin-film layers exposed in the fluid feed channels 44 of a FIT printhead. The FIT printhead is comprised of a semiconductor substrate 20 with a stack of thin-film layers 50, including an energy dissipating element 32 and a plurality of fluid feed slots 30 defamed within the stack of thin-film layers 50, and an orifice layer 34. The orifice layer 34 has etched in it an orifice 42, or a pattern of orifices, positioned respective to the energy dissipation element 32 and exposing the fluid feed slots 30. The semiconductor substrate 20 has a fluid feed channel 44 etched in the side opposite to orifice 42. The fluid feed channel 44 is etched to expose the fluid feed slots 30. During operation of the printhead, fluid is coupled from the fluid feed channel 44 through the fluid feed slots 30 directly into the cavity of orifice 32. The energy dissipation element 32 is energized and it heats the fluid to create a bubble which causes the remaining fluid in the orifice 42 to eject. The integrated heat-sink then removes any remaining heat from energy dissipating element 32 into semiconductor substrate 20 and fluid in the fluid feed channels 44.

FIG. 1 shows a top view of a single orifice 42 in an orifice layer 34. Energy dissipation element 32 is typically a resistor, however, those skilled in the art will appreciate that other energy coupling devices such as piezoelectric or electro-restrictive materials are possible and still fall within the spirit and scope of the invention. Section AA shows the direction that cross-sections of various embodiments of the invention are viewed in later figures.

FIG. 2 is an isometric drawing of a single orifice showing the basic structure of the FIT architecture with the preferred embodiment of the integrated heat-sink. A fluid, such as ink, flows in the fluid feed channel 44, which is etched into a semiconductor substrate 20.

Figure 3A:
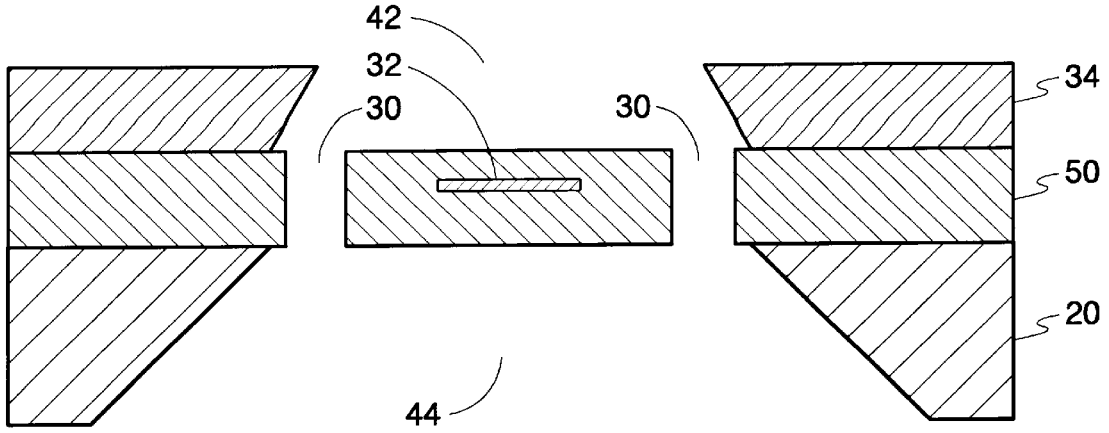
FIGS. 3A, 3B, and 3C cross sectional views show the process steps used to create the preferred embodiment.
Figure 3B:
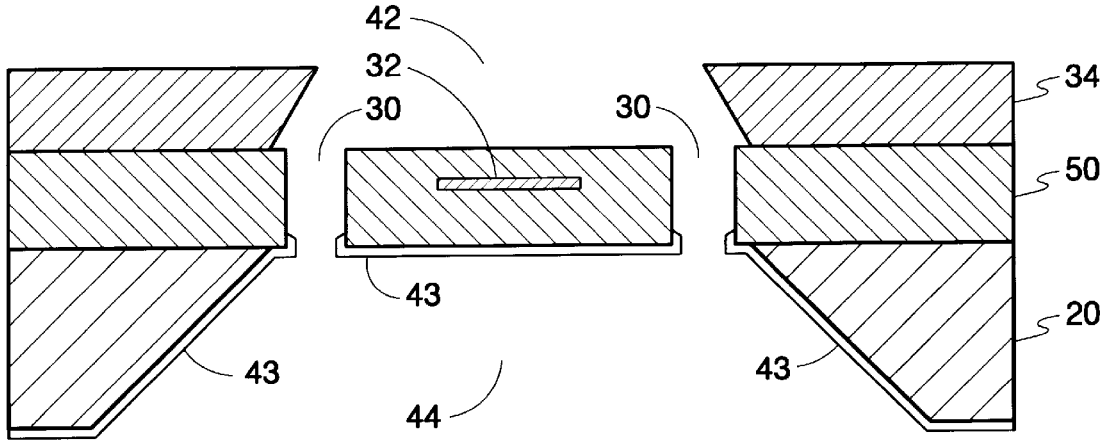
Figure 3C:
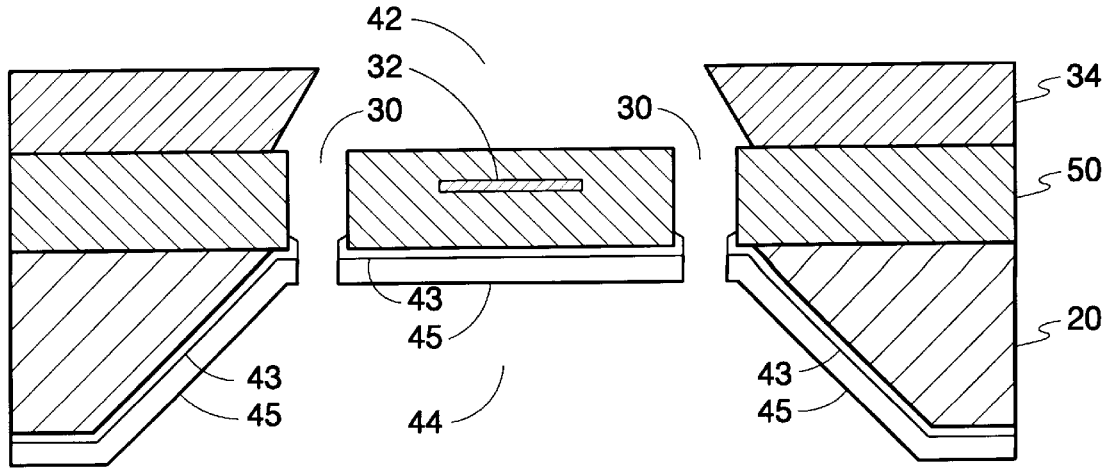

FIGS. 3A–3C illustrate the process used to make the preferred embodiment. Applied on semiconductor substrate 20 is a stack of thin-film layers 50, which contain the energy dissipation element 32. An orifice layer 34 is applied on the stack of thin-film layers 50 and a nozzle orifice 42 (an opening or a hole) is created to expose the energy dissipation element 32 and fluid feed slots 30. The fluid feed slots 30 extend through the stack of thin-film layers and open into the fluid feed channel 44. The preferred embodiment applies a flash of an adhesion layer 43 (FIG. 3B), preferably tantalum, to a thickness of 100 to 500 Angstroms. Next, a layer of metal 45 with a thickness of approximately 1 to 2 microns is then applied over the adhesion layer 43 (FIG. 3C). The metal layer 45 is preferably comprised of an inert metal such as gold, palladium, tungsten, or titanium tungsten, but preferably gold. Those skilled in the art will appreciate that other inert metals exist and could be used and still fall within the spirit and scope of the invention. Typically, the adhesion layer 43 and metal layer 45 would be deposited using a conventional physical vapor deposition process (see Thin Film Processes II, J. L. Vossen & W. Kern, editors, Academic Press, New York, 1991, ch. 2–4). In addition, a third layer (not shown) can be applied over the metal layer to provide an adhesion layer for attachment of the printhead to a cartridge.

In those instances where it is undesirable to have the entire backside of a printhead coated with metal, the adhesion layer 43 and metal layer 45 can be selectively placed by using photoresist and patterning an opening in those areas in which the adhesion layer 43 and metal layer 45 are desired. The patterning should at least be such that the inside of the fluid feed channel 44 is coated to create an effective heat path from 25 the stack of thin-film layers 50 to the semiconductor substrate 20. See FIGS. 9F and 9G for examples of pattern layouts (shown as area 17 and alternate area 17').

Figure 4:
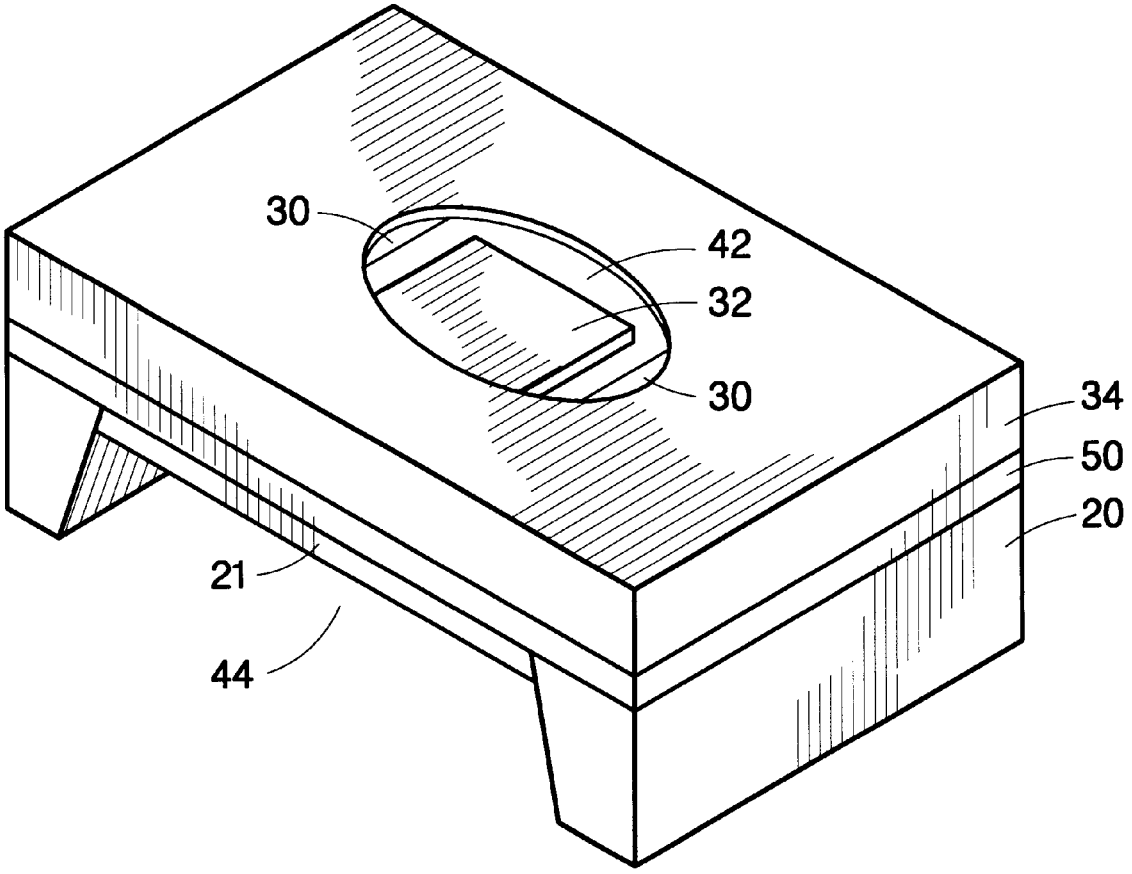
FIG. 4 is an isometric cross sectional view of a single orifice of a FIT fluid printhead showing a first-alternate embodiment of the integrated heat-sink.

FIG. 4 shows the first alternative embodiment which provides an integrated heat-sink that is formed by preprocessing the FIT semiconductor substrate 20 rather than post processing it as in the preferred embodiment. The integrated heat-sink is a layer of crystalline semiconductor 21, approximately 1 to 2 microns thick.

Figure 5A:
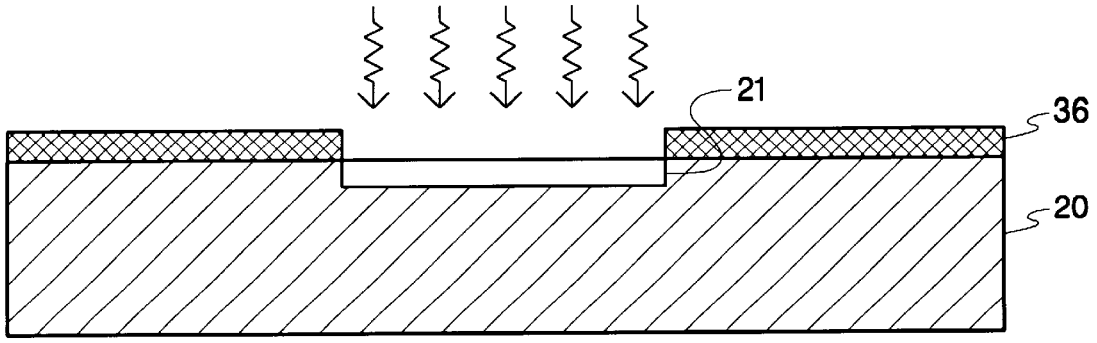
FIGS. 5A, 5B, and 5C cross sectional views show the process steps used to create the first-alternative embodiment.
Figure 5B:
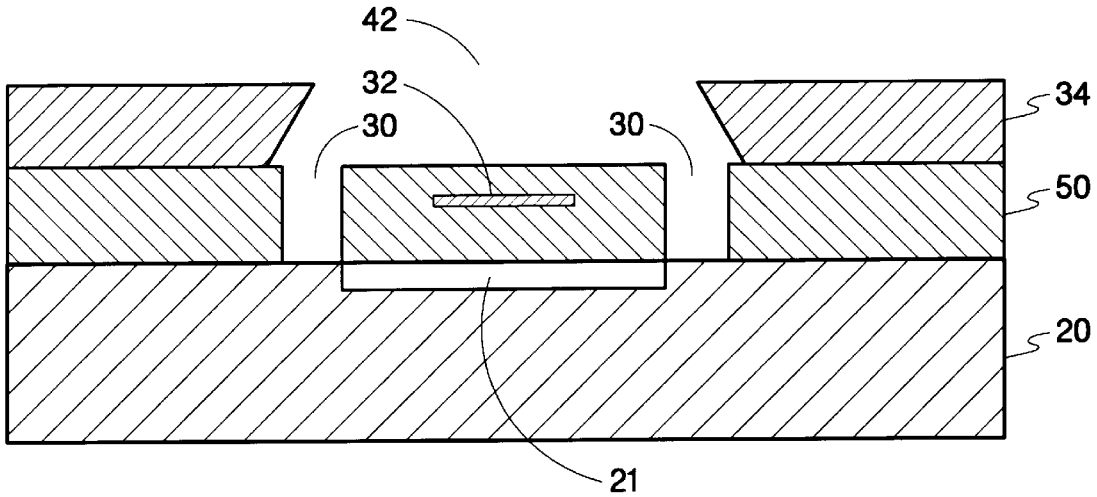
Figure 5C:
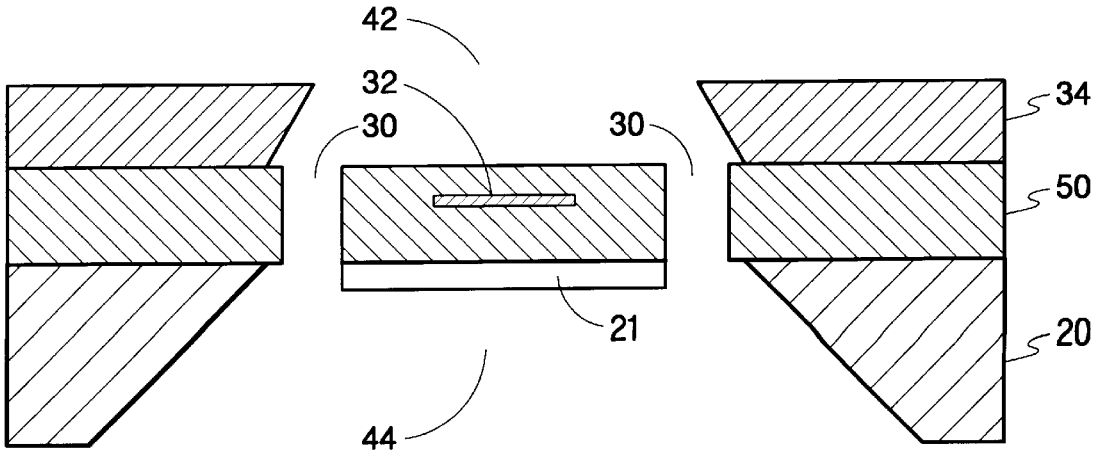

FIGS. 5A–5C illustrate the process used to make the first alternate embodiment. The layer of crystalline semiconductor 21 is formed by conventionally masking the semiconductor substrate 20 with mask 36 to create a masked area opening which is the doped with a p-type dopant such as boron to an approximate depth of 1 to 2 microns. The mask 36 is then removed. A stack of thin-film layers 50 (FIG. 5B), which contains energy dissipating element 32 and has fluid feed slots 30 defined within, is then applied to the semiconductor substrate 20. An orifice layer 34 is then applied to the stack of thin-film layers 50 and an orifice 42 is etched in the orifice layer 34 which is positioned above energy dissipating element 32 and exposes fluid feed slots 30. The fluid feed slots 30 extend through the stack of thin-film layers 50 into fluid feed channel 44, which is created (in FIG. 5C) by etching. It is important in this first alternate embodiment that the semiconductor area in the location of the fluid feed slots 30 be masked to prevent the boron doping. The boron doping passivates the semiconductor substrate that has been doped from being etched when the fluid feed channel 44 is created by a tetramethyl ammonium hydroxide (TMAH) etch process (see U. Schnakenberg, W. Benecke and P. Lange, TMAHW Etchants for Silicon Micromaching, Tech. Dig., 6$^{th}$ Int. Conf. Solid State Sensors and Actuators (Tranducers '91), San Francisco, Calif. USA, Jun. 24–28, 1991 pp.815–818). After the fluid feed channel 44 is etched, the layer of doped crystalline semiconductor 21 conducts heat from the stack of thin-film layers 50 to the semiconductor substrate 20.

Figure 6:
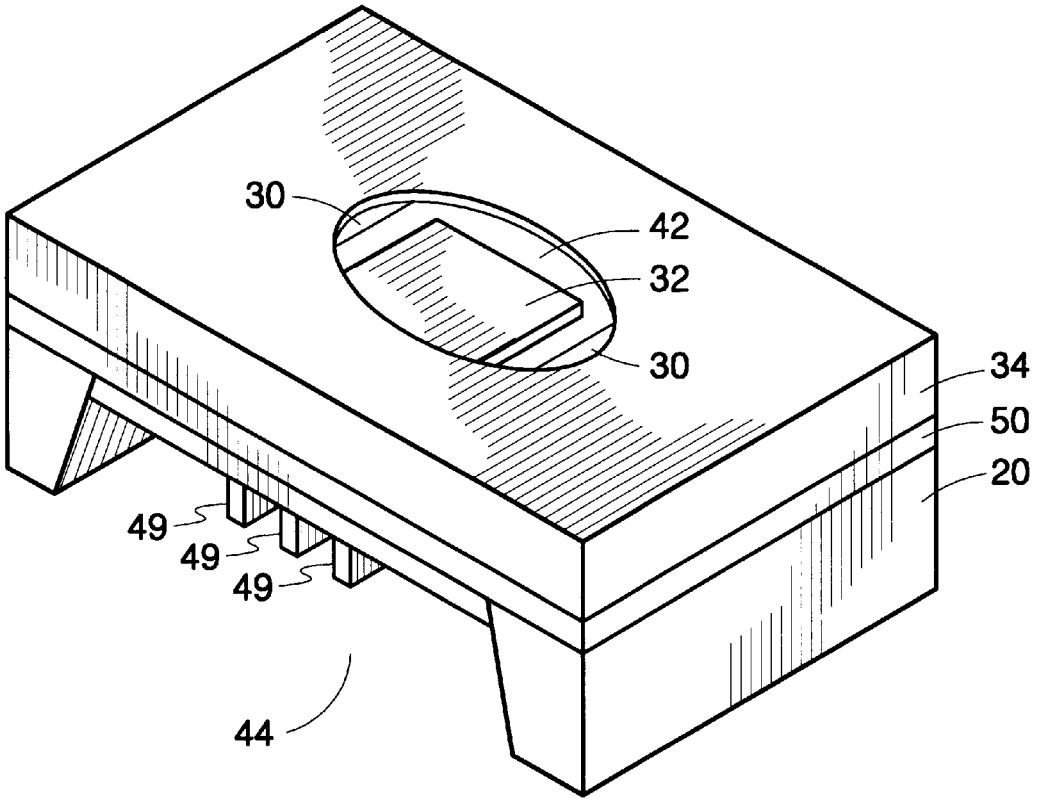
FIG. 6 is an isometric cross sectional view of a single orifice of a FIT fluid printhead showing a second-alternate embodiment of the integrated heat-sink.
Figure 7A:
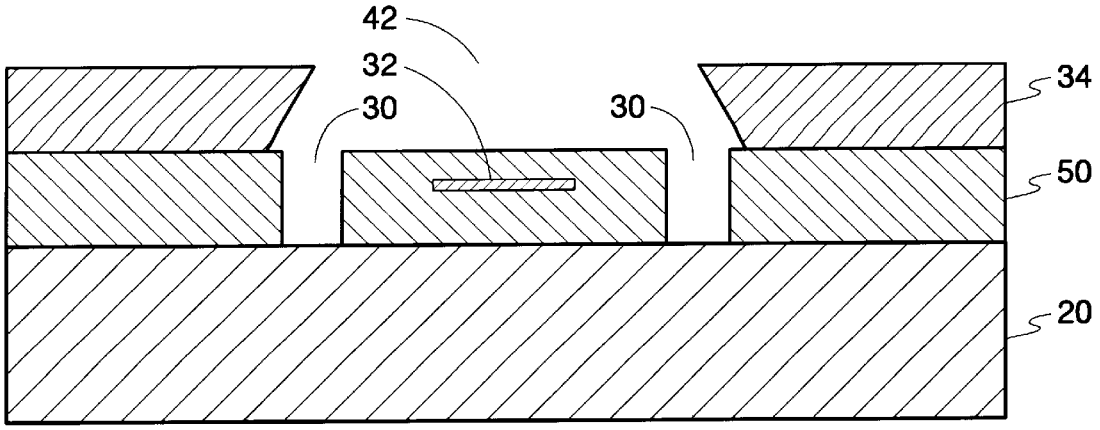
FIGS. 7A, 7B, and 7C cross sectional views show the process steps used to create the second-alternative embodiment.
Figure 7B:
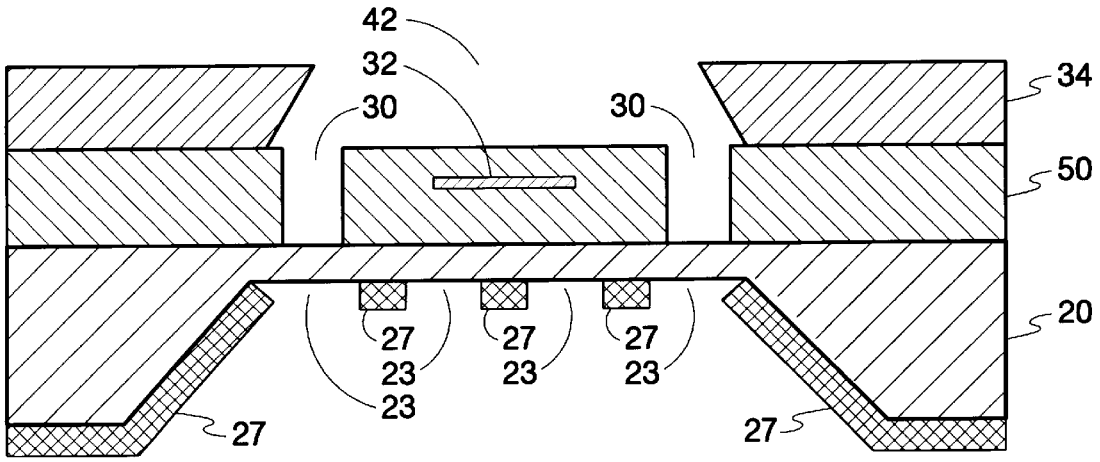
Figure 7C:
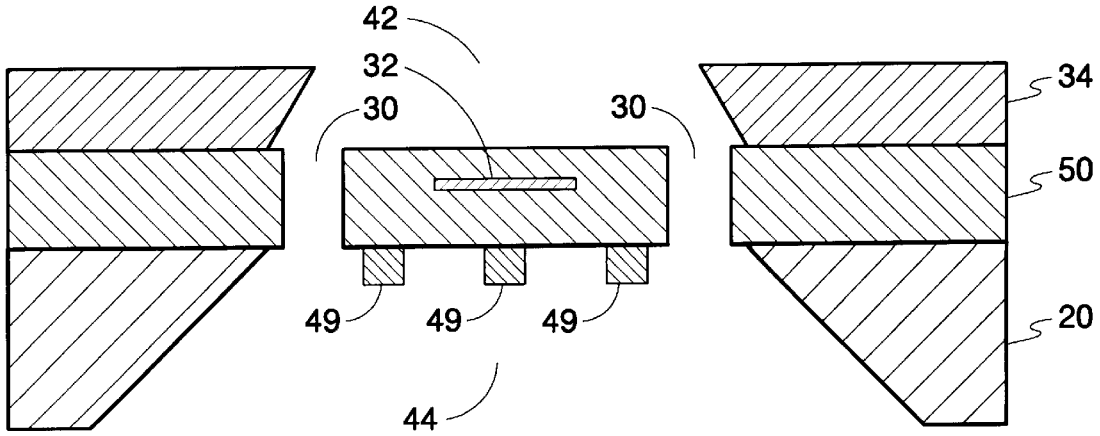

FIG. 6 shows a second alternate embodiment which modifies the TMAH process used to create the fluid feed channels 44. This embodiment creates a layer of crystalline semiconductor 23 similar to the first alternate embodiment's doped crystalline semiconductor 21 but with the flexibility to greatly increase the thickness of the layer of crystalline semiconductor 23 and the ability to pattern the layer of crystalline semiconductor 23 to create fins 49 which increase the surface area of the heat-sink. FIGS. 7A–7C illustrate the process used to make the second alternate embodiment. FIG. 7A shows the semiconductor substrate 20 after it has been processed as described earlier to include the stack of thin-film layers 50 and the orifice layer 34. The energy dissipation element 32 is within the stack of thin-film layers 50. The orifice 42 is etched into the orifice layer 34 and is positioned over energy dissipation element 32 and exposes the fluid feed slots 30. The fluid feed slots 30 are defined as openings in the stack of thin-film layers 50.

FIG. 7B shows the semiconductor substrate 20 after it has been partially etched in a TMAH etch process. The TMAH etching is stopped after a predefined time to create the desired thickness of the layer of crystalline semiconductor. A mask 27 is placed on the partially etched surface of the semiconductor substrate 20 to prevent etching where the mask 27 is present. An anisotropic dry etch, rather than the isotropic TMAH etch, is then performed to finish etching the semiconductor substrate 20 without undercutting under mask 27 to expose the fluid feed slots 30 to the fluid feed channel 44. An exemplary dry etch is a reactive ion etch (see Dry Etching for VLSI, A. J. van Roosmalen, J. A. G. Baggerman, & S. J. H. Brader, Plenum Press, New York, 1991). The semiconductor under the mask 27 is not etched thus forming fins 49, which remain after mask 27 is removed as shown in FIG. 7C.

Figure 8:
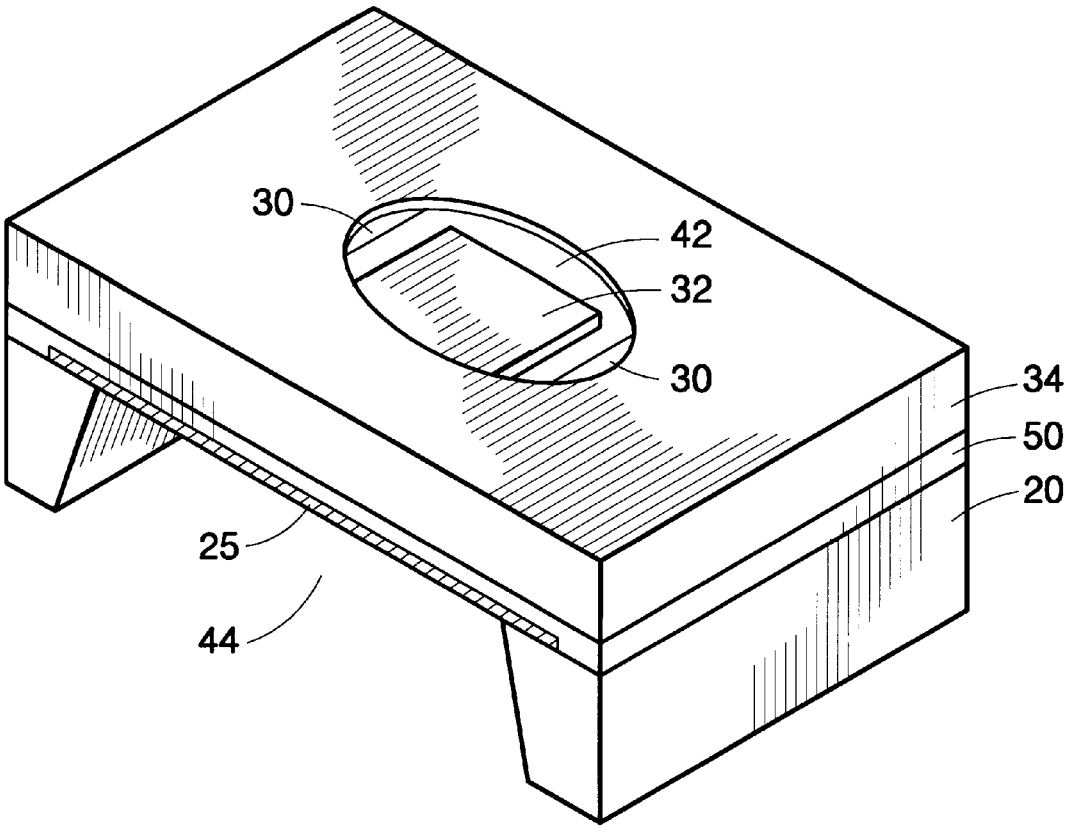
FIG. 8 is an isometric cross sectional view of a single orifice of a FIT fluid printhead showing a third-alternate embodiment of the integrated heat-sink.

FIG. 8 shows the third alternate embodiment which creates the integrated heat-sink by applying a thermally-conductive material 25 on the semiconductor substrate 20 before the stack of thin-film layers 50 is applied.

Figure 9A:
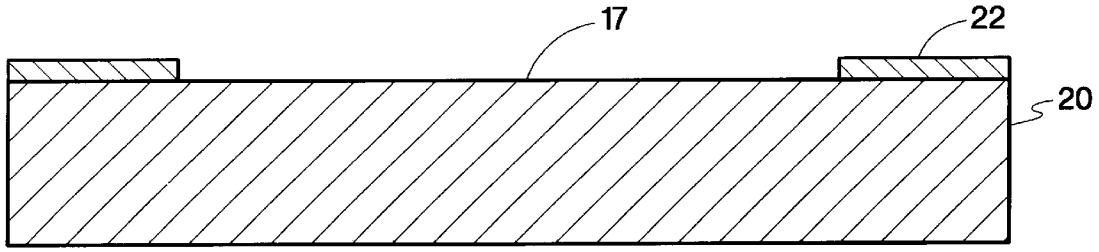
FIGS. 9A through 9E cross sectional views show the process steps to create the third-alternative embodiment.
Figure 9B:
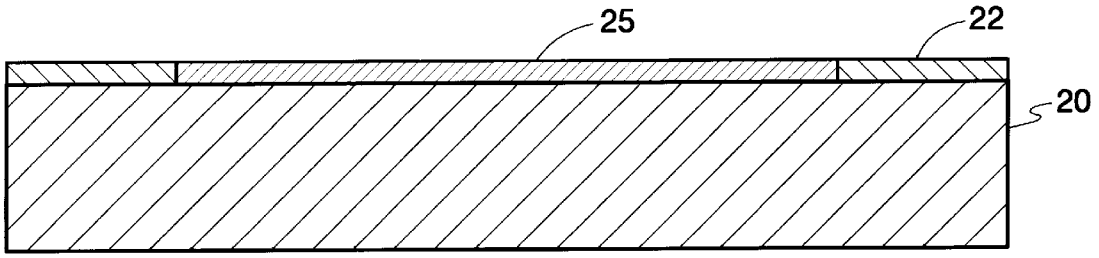
Figure 9C:
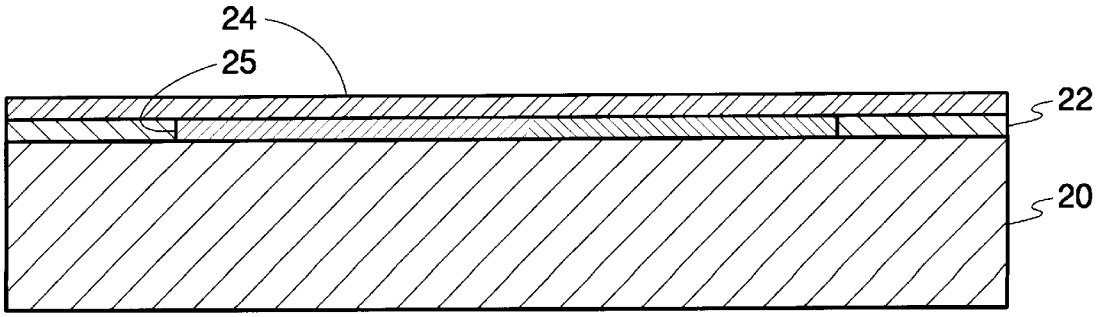
Figure 9D:
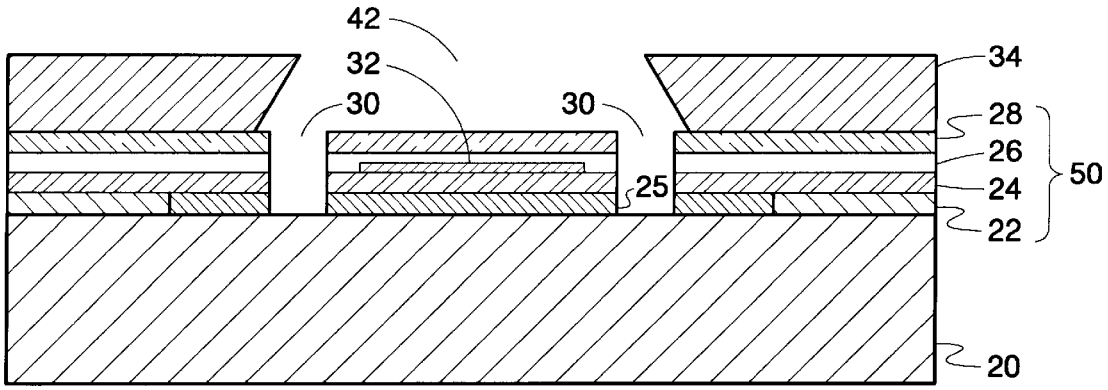

FIGS. 9A–9E illustrate the process used to create the third alternate embodiment. FIG. 9A shows the semiconductor substrate 20 with a layer of silicon dioxide 22 which has been grown and etched to form an area 17 (see commonly assigned U.S. Pat. No. 4,978,420 for representive etch techniques). FIG. 9B shows the application of a layer of thermally-conductive material 25, such as titanium tungsten (TiW), aluminium, or preferably tantalum which is placed in the area from which the layer of silicon dioxide 22 has been etched. FIG. 9C shows the application of a layer of phosphosilicate glass (PSG) which is applied over the layer of thermally-conductive material 25 and the layer of silicon dioxide 22. The isolation layer 26 shown in FIG. 9D is typically a composition of dielectric layers such as silicon nitride and silicon carbide. Protective layer 28 is typically a passivation layer of tantalum to protect the thin-film stack 50. Those skilled in the art will appreciate that the thin-film stack 50 could be any composition of thin-film layers and still fall within the spirit and scope of the invention.

FIG. 9D shows the result after the remaining components of stack of thin-film layers 50, which includes energy dissipating element 32, and orifice layer 34 are processed as described earlier. Fluid feed slots 30 are defined during processing of the stack of thin-film layers 50. The orifice layer 34 is etched to create orifice 42.

Figure 9E:
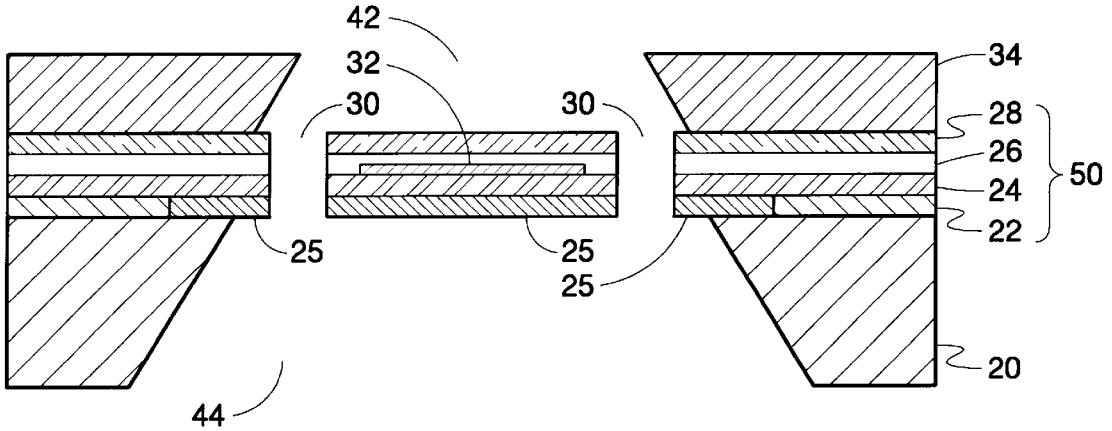

FIG. 9E shows the result of the TMAH etch used to create the fluid feed channel 44 which exposes the layer of thermally-conductive material 25. The layer of thermally-conductive material 25 transfers heat from the stack of thin-film layers 50 to the semiconductor substrate 20.

Figure 9F:
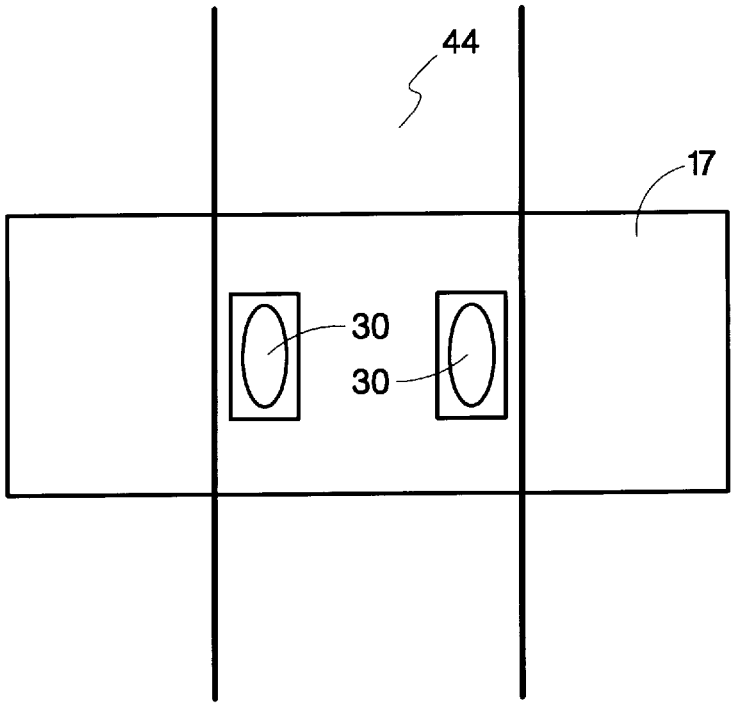
FIG. 9F shows the preferred pattern for creating the integrated heat-sink from FIGS. 9A–9F.

FIG. 9F shows the layout of area 17 with respect to fluid feed slots 30 and fluid feed channel 44. This area 17 allows heat from energy dissipation element 32 to be conducted to both the semiconductor substrate and to the fluid in fluid feed slot 44.

Figure 9G:
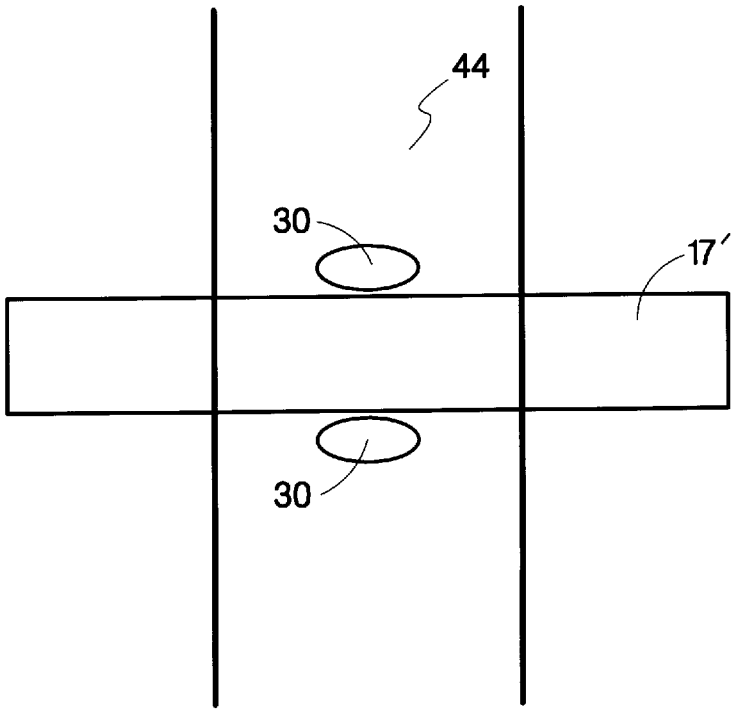
FIG. 9G shows an alternate pattern if the fluid feed slots are oriented differently with respect to the fluid feed channel.

FIG. 9G shows an alternate area 17' that is used if fluid feed slots 30 are oriented as shown in fluid feed channel 44. This fluid feed slot orientation approach can also be used with other embodiments described within this specification and still fall within the spirit and scope of the invention.

Figure 10:
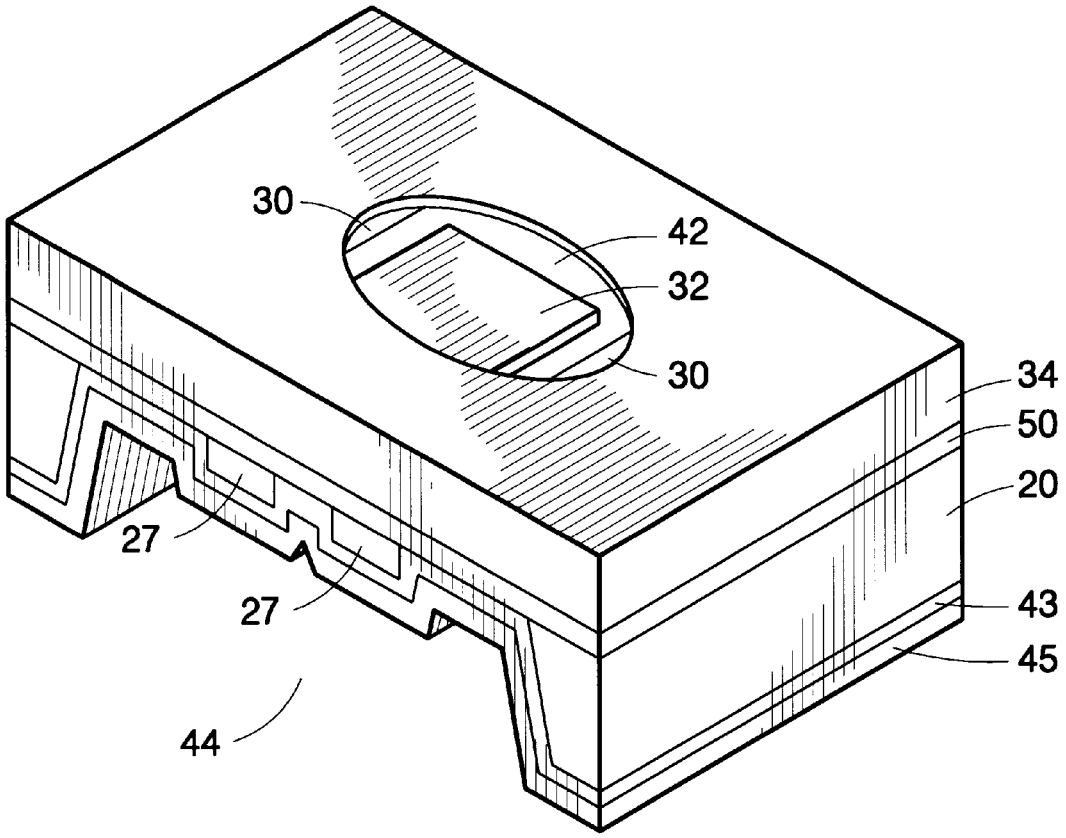
FIG. 10 is an isometric cross sectional view of a single orifice of a FIT fluid printhead showing a fourth-alternate embodiment of the integrated heat-sink.

FIG. 10 represents a fourth alternate embodiment, which creates more surface area for the heat-sink described in the preferred embodiment. Fins 27 are formed by preprocessing the semiconductor substrate 20 to etch areas as described earlier before applying the stack of thin-film layers 50 and orifice layer 34. The fins 27 are comprised of silicon dioxide and PSG. Since these materials have low thermal conductivity, the fins 27 and the semiconductor substrate 20 are coated by phyical vapor deposition with an adhesion layer 43 and metal layer 45. The adhesion layer is preferably tantalum. The metal layer is an inert metal such as gold, palladium, or platinum, preferably gold.

Figure 11A:
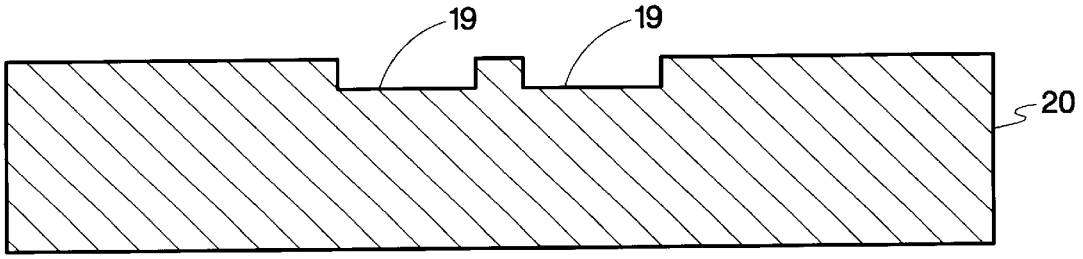
FIGS. 11A through 11F cross sectional views show the process steps to create the fourth-embodiment.

FIG. 11A–FIG. 11F illustrate the process steps used to create the fourth alternate embodiment. FIG. 11A shows the starting semiconductor substrate 20. The semiconductor substrate 20 is then etched, either isotropically or anisotropically to form, respectively, cross sectional viewed semicircular or rectangular structures 19. FIG. 11A shows the result of the preferable anisotropic etch. An exemplary anisotropically etch is to use a conventional reactive ion etch technique (see W. Lang, Silicon Microstructuring Technology, Materials Science & Engineering, R17, p. 1–55, 1996). An exemplary isotropically etch is to use a conventional high frequency nitric chemistry technique.

Figure 11B:
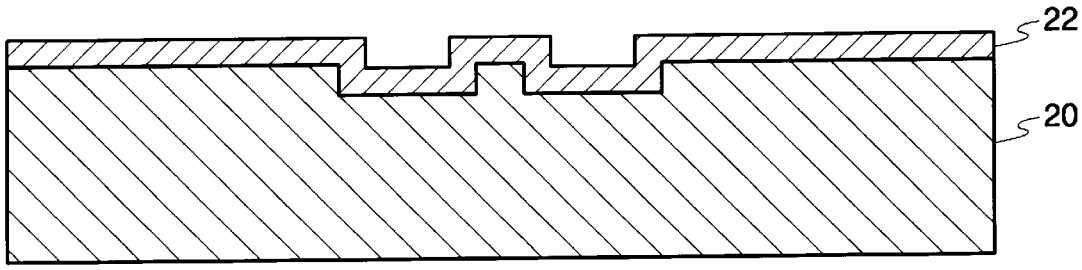
Figure 11C:
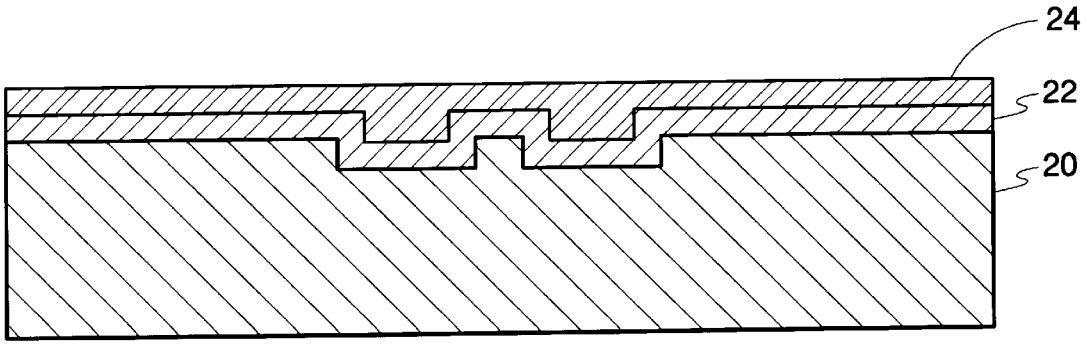
Figure 11D:
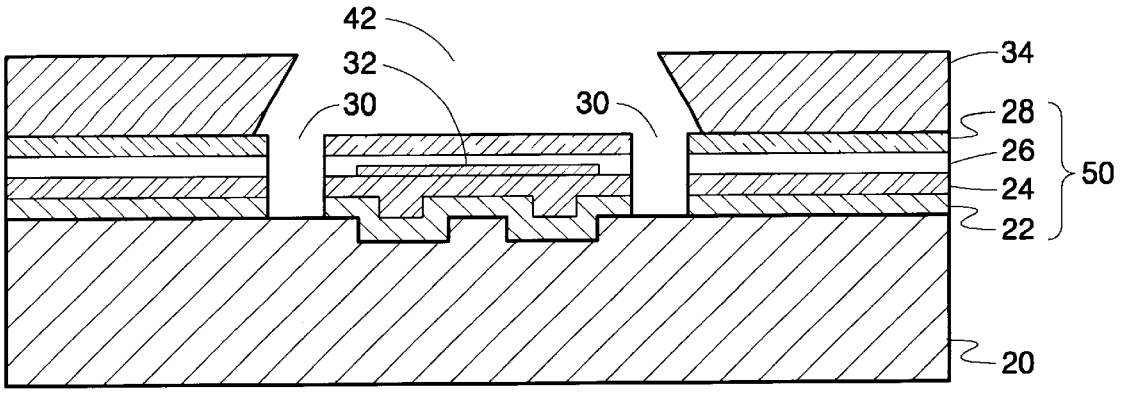

FIG. 11B shows the result from growing a conformal layer of silicon dioxide 22 on the semiconductor substrate 20. FIG. 11C shows the result after a conformal layer of PSG 24 is applied on the layer of silicon dioxide 22 and after it has been planarized using a resist etch-back, a spin-on-glass or preferably a chemical mechanical planarization (CMP) process. Those skilled in the art will appreciate that other planarization processes exist and still fall within the spirit and scope of the invention. The remaining stack of thin-film layers 50, including energy dissipating element 32 is then processed onto the conformal layer of PSG 24 in the manner described above as shown in FIG. 11D. FIG. 11D also shows the result after applying the orifice layer 34 and etching an orifice 42 which is positioned above energy dissipating element 32 and which exposes fluid feed slots 30 which extend through the stack of thin-film layers 50.

Figure 11E:
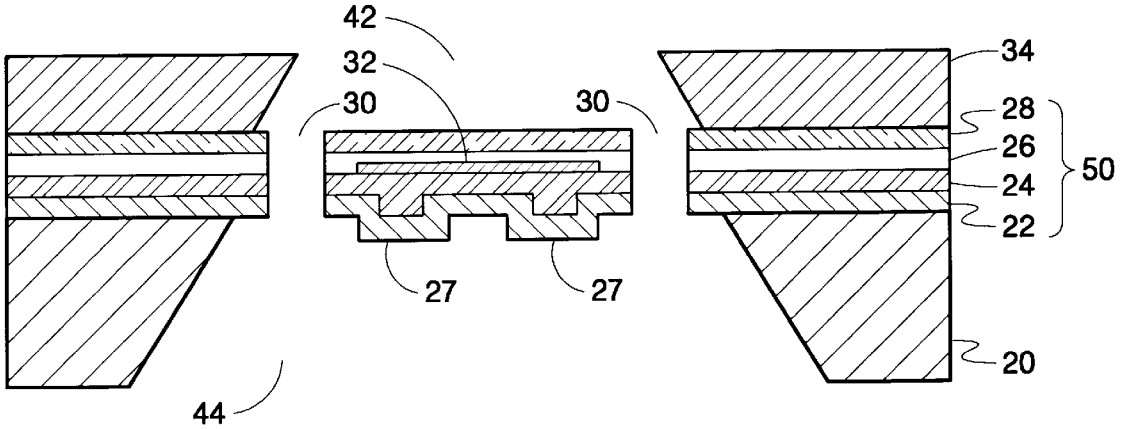
Figure 11F:
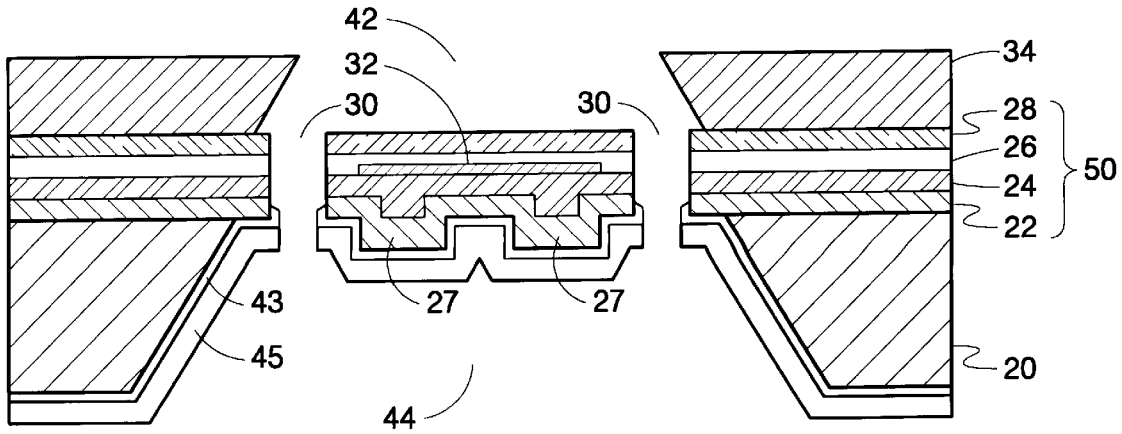

FIG. 11E shows the result of the TMAH etch of the fluid feed channel 44 in the semiconductor substrate 20 which exposes the fins 27 which are comprised of silicon dioxide and PSG. FIG. 11F shows the result after a flash of adhesion layer 43, preferably tantalum, is applied across the surface of semiconductor substrate 20 and fins 27. Finally, there is also shown a layer of metal 45 from one of the inert metals gold, palladium, or platinum, preferably gold. The metal layer 45 not only conducts heat to semiconductor substrate 20 but the increased surface area created by fins 27 help to transfer heat from the stack of thin-film layers 50 to the fluid in the fluid feed channel 44.

Figure 12A:
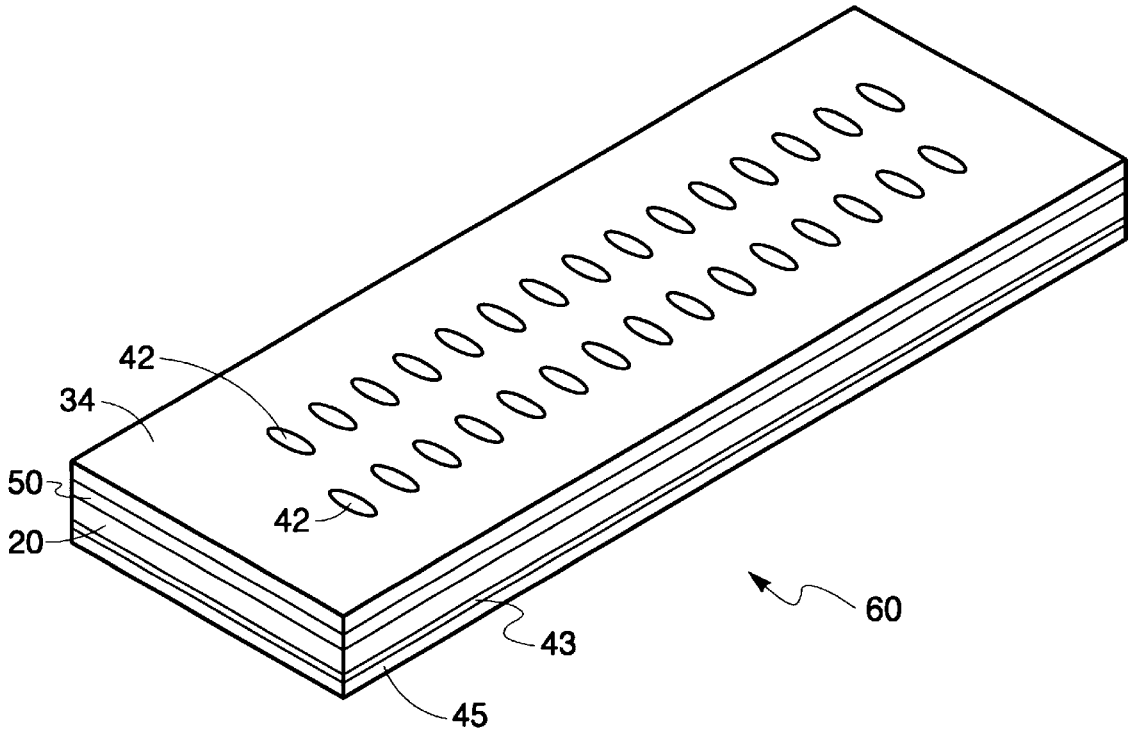
FIG. 12A shows an isometric view of the preferred embodiment of an exemplary printhead having multiple orifices.
Figure 12B:
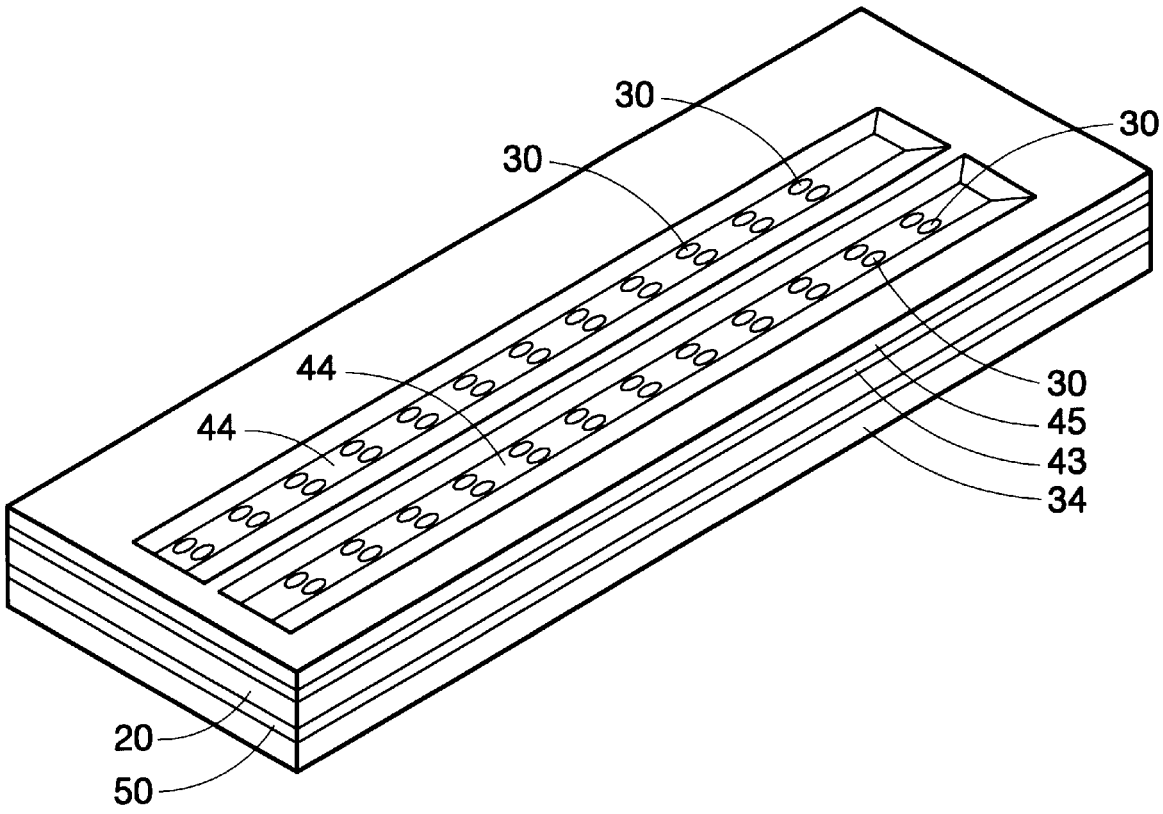
FIG. 12B shows an isometric view of the preferred embodiment of an exemplary printhead and its fluid feed channels and fluid feed slot openings.

FIG. 12A shows an exemplary printhead of the preferred embodiment constructed from semiconductor substrate 20, stack of thin-film layers 50 and orifice layer 34. A plurality of orifices 42 are etched in the orifice layer 34. The semiconductor substrate 20 also has an adhesion layer 43 and metal layer 45, which form the integrated heat-sink. FIG. 12B shows the reverse side of printhead 60. Fluid feed channels 44 direct fluid to fluid feed slots 30.

Figure 13:
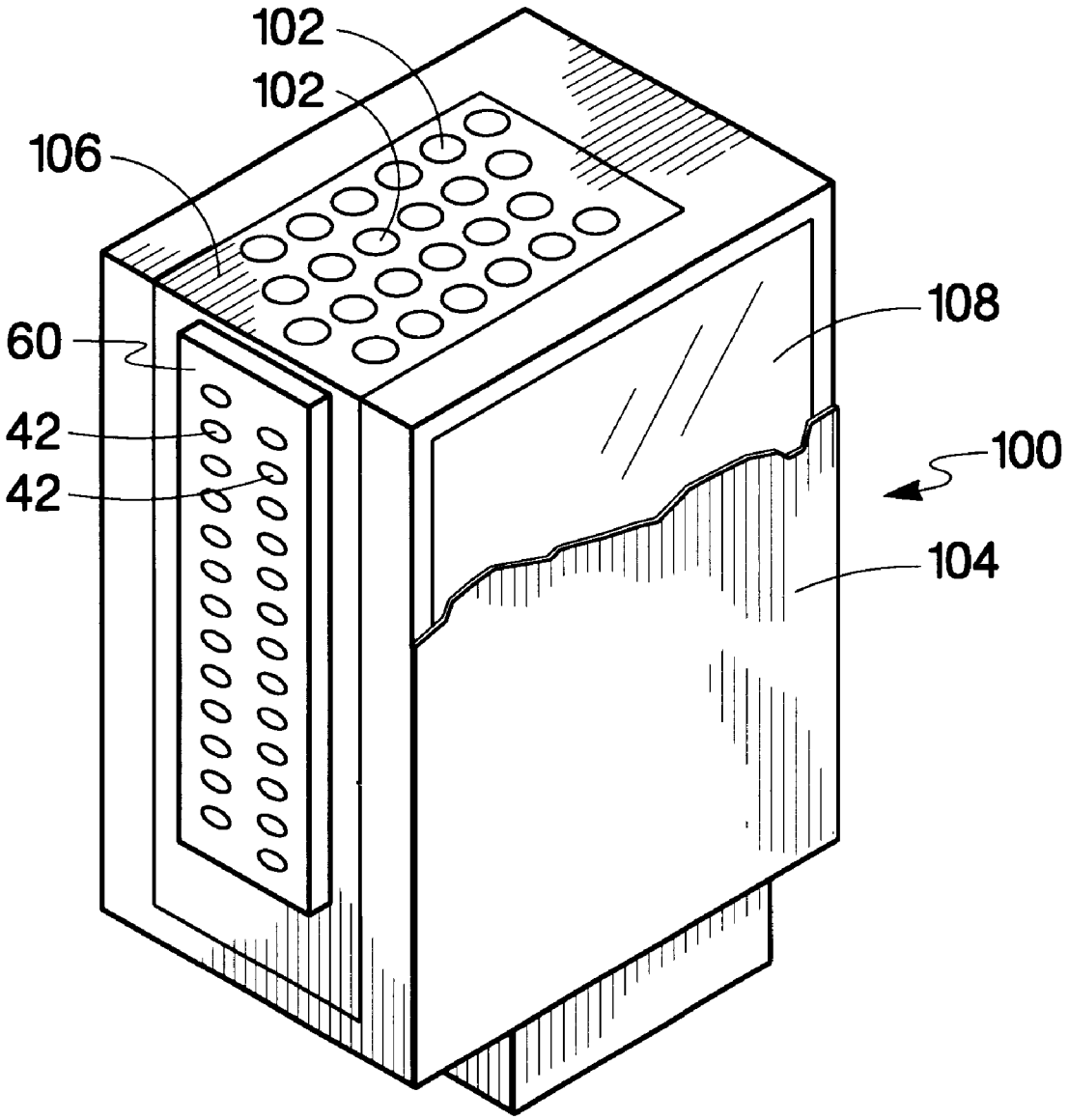
FIG. 13 shows an exemplary print cartridge using an exemplary printhead.

FIG. 13 illustrates an exemplary print cartridge 100 that utilizes printhead 60. Such a print cartridge could be similar to a HP51626A available from Hewlett-Packard Co., but utilizing the inventive printhead described above. Printhead 60 is attached to a flex circuit 106 which electrically couples printhead 60 with electrical contacts 102. Orifices 42 eject liquid when appropriate control signals are applied to contacts 102. The fluid ejected is stored in fluid container 104. A fluid delivery assemblage, an exemplary example being a sponge 108 and a standpipe (not shown), conveys the fluid in container 104 to the printhead 60 such that an adequate back pressure is maintained to prevent fluid leakage.

Figure 14:
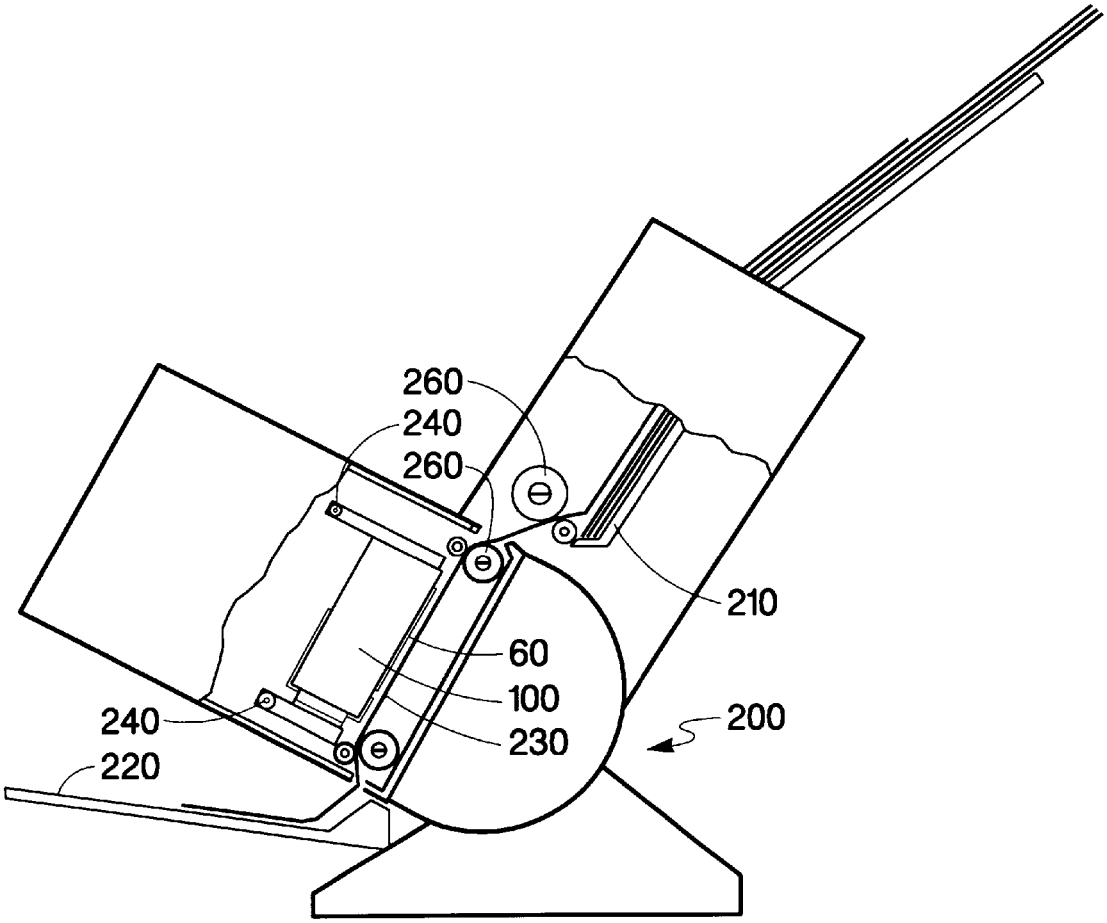
FIG. 14 shows an exemplary recording device which uses the exemplary print cartridge.

FIG. 14 shows an exemplary recording apparatus 200, similar to a Hewlett-Packard Deskjet 340 (C2655A), for placing the fluid in cartridge 100, upon ejection from printhead 60, onto a medium 230. A conveyance assemblage 240 moves the cartridge 100 across the width of the media 230. Media feed mechanism 260 advances the media 230 past the printhead 60 to record along the length of the media 230. Additional media is supplied from media tray 210 after the recorded media 230 is ejected onto tray 220.

What is claimed is:

1. A printhead for ejecting fluid having a first surface and a second surface, said first surface having at least one orifice, said second surface having a fluid feed channel, the printhead comprising:

a thin-film area exposed within said fluid feed channel;

a first layer of adhesive material disposed on said second surface, said fluid feed channel and the exposed thin-film area; and a heat sink disposed on said first layer of adhesive material wherein the fluid is in contact with the heat sink.

2. The printhead of claim 1 wherein the heat sink comprises a layer of doped crystalline silicon disposed on said exposed thin-film area.

3. The printhead of claim 1 wherein the heat sink comprises a layer of thermally conductive material disposed on said exposed thin-film area.

4. A printhead for ejecting fluid having a first surface and a second surface, said first surface having at least one orifice, said second surface having a fluid feed channel, said fluid feed channel having an exposed thin-film area, comprising:

a first layer of adhesive material disposed on said second surface, said fluid feed channel and said exposed thin-film area;

a layer of metal disposed on said first layer of adhesive material; and a second layer of adhesive material disposed on said layer of metal.

5. A printhead for ejecting fluid having a first surface and a second surface, said first surface having at least one orifice, said second surface having a fluid feed channel, said fluid feed channel having an exposed thin-film area, comprising a set of cooling fins comprised of silicon dioxide and PSG disposed on said exposed thin-film area.

6. A printhead with an integrated heat-sink for ejecting fluid, comprising:

a semiconductor substrate having a first surface and a second surface, a stack of thin-film layers disposed on said first surface of said semiconductor substrate;

a fluid feed slot established through said stack of thin-film layers;

an orifice layer having at least one orifice defined therein, said orifice layer disposed upon said stack of thin-film layers, said at least one orifice positioned with respect to said fluid feed slot;

a energy dissipating element positioned within said stack of thin-film layers and positioned respective to said at least one orifice;

a fluid feed channel defined within said second surface of said semiconductor substrate and extending to said first surface of said semiconductor substrate, and said fluid feed slot opening into said fluid feed channel; and said integrated heat-sink attached to said stack of thin-film layers within said fluid feed channel on said second surface of said semiconductor substrate.

7. The printhead with an integrated heat-sink as in claim 6, wherein said integrated heat-sink further comprises:

a layer of tantalum attached to said stack of thin-film layers on said second surface of said semiconductor substrate; and a metal layer attached to said layer of tantalum.

8. The printhead with an integrated heat-sink as in claim 7, wherein said metal layer further comprises approximately 1 to 2 microns of inert metal selected from the group consisting of gold, palladium and platinum.

9. The printhead with an integrated heat-sink as in claim 7, wherein said integrated heat-sink further extends and attaches over substantially the entirety of said second surface of said semiconductor substrate.

10. The printhead with an integrated heat-sink as in claim 6, wherein said integrated heat-sink further comprises a layer of doped crystalline silicon attached to said stack of thin-film layers on said second surface of said semiconductor substrate.

11. The printhead with an integrated heat-sink as in claim 10 wherein said layer of doped crystalline silicon further comprises at least one fin.

12. The printhead with an integrated heat-sink as in claim 10 wherein said layer of doped crystalline silicon is doped with boron.

13. The printhead with an integrated heat-sink as in claim 6 wherein said integrated heat-sink further comprises at least one fin comprised of silicon dioxide and phosphosilicate glass.

14. The printhead with an integrated heat-sink as in claim 11, further comprising:

a layer of tantalum attached to said at least one fin on said second surface of said semiconductor substrate; and a metal layer attached to said layer of tantalum.

15. The printhead with an integrated heat-sink as in claim 14, wherein said metal layer further comprises 1 to 2 microns of inert metal from the group consisting of gold, palladium and platinum.

16. The printhead with an integrated heat-sink as in claim 11, wherein said at least one fin forms a ridge with a semi-circular cross-section.

17. A method for creating an integrated heat-sink for a printhead having a first surface and a second surface, said first surface having at least one orifice, said second surface having a fluid feed channel, said fluid feed channel having at least one exposed thin-film area, the method comprising the steps of:

applying a layer of adhesive material encompassing said second surface including said fluid feed channel and said at least one exposed thin-film area; and applying a layer of metal on said layer of adhesive material encompassing said second surface including said fluid feed channel and said at least one exposed thin-film area.

18. A printhead having an integrated heat-sink produced in accordance with the method of claim 17.

19. The method in accordance with claim 17, further comprising the steps of:

patterning said second surface to selectively place said layer of adhesive material on said at least one exposed thin-film area; and patterning said second surface to selectively place said layer of metal on said layer of adhesive material.

20. The method in accordance with claim 17 wherein said step of applying a layer of adhesive material further comprises depositing a layer of tantalum 100 to 500 angstroms thick.

21. The method in accordance with claim 17 wherein said step of applying a layer of metal further comprises depositing a layer of metal 1 to 2 microns thick.

22. The method in accordance with claim 17 wherein said step of applying a layer of metal further comprises depositing a layer of inert metal from the group consisting of gold, palladium, and platinum.

23. A method for creating an integrated heat-sink for a printhead having a semiconductor substrate having a first surface and a second surface, comprising the steps of:

masking said first surface of said semiconductor substrate with a mask material whereby a masked area opening is created;

doping said masked area opening with boron thereby creating a doped area;

removing said mask material;

processing at least said doped area of said semiconductor substrate with thin-film layers thereby creating a stack of thin-film layers; and depositing an orifice layer on said stack of thin-film layers.

24. A printhead having an integrated heat-sink produced in accordance with the method of claim 23.

25. The method in accordance with claim 23, wherein said stack of thin-film layers further comprise an energy dissipating element, and a fluid feed slot, the method further comprising the steps of:

etching said orifice layer thereby creating at least one orifice in association with said energy dissipating elements and said fluid feed slot; and etching a fluid feed channel in said second surface of said semiconductor substrate whereby said doping of masked area opening with boron is passivated to said etching of said fluid feed channel.

26. The method in accordance with claim 23, wherein said doping of said masked area with boron penetrates to a depth of 1 to 2 microns.

27. A method for creating an integrated heat-sink for a printhead having a semiconductor substrate having a first surface and a second surface, said first surface having a stack of thin-film layers having a fluid feed slot extending through a thickness of said stack of thin-film layers, an orifice layer having at least one orifice disposed on said stack of thin-film layers, comprising the steps of:

partially etching a fluid feed channel in said second surface of said semiconductor substrate;

masking said second surface of said semiconductor substrate to define a heat-sink area; and anisotropically etching said second surface of said semiconductor substrate to expose said fluid feed slot whereby a crystalline semiconductor layer is formed in said heat-sink area.

28. A printhead having an integrated heat-sink produced in accordance with the method of claim 27.

29. The method in accordance with claim 27, wherein said steps of:

masking said second surface further comprises masking said second surface with a pattern that defines locations of a set of fins; and anisotropically etching said second surface further comprises creating said set of fins.

30. A method for creating an integrated heat-sink with a set of cooling fins for a printhead having a semiconductor substrate with a first surface and a second surface, comprising the steps of:

masking said first surface of said semiconductor substrate thereby creating a masked area;

etching said first surface of said semiconductor substrate outside said masked area thereby forming at least one trench;

growing a layer of silicon dioxide on said first surface of said semiconductor surface and inside said at least one trench;

applying a layer of phosphosilicate glass (PSG) on said layer of silicon dioxide on said semiconductor surface;

processing said semiconductor substrate first surface with thin-films to create a stack of thin-film layers disposed on said layer of PSG; and applying an orifice layer on said stack of thin-film layers.

31. A head for ejecting fluid having a heat-sink produced in accordance with the method of claim 30.

32. The method associated with claim 30 whereby the stack of thin-film layers created further comprise, said layer of silicon dioxide, said layer of PSG, an energy dissipating element, and a fluid feed slot; and the method further comprises the steps of:

planarizing said layer of PSG with a chemical mechanical planarization technique;

etching said orifice layer thereby creating at least one orifice positioned respective to said energy dissipating element and said fluid feed slot; and etching a fluid feed channel in said second surface of said semiconductor substrate thereby exposing said fluid feed slot and thereby creating said set of cooling fins comprised of said layer of silicon dioxide and said layer of PSG.

33. The method in accordance with claim 30 wherein said etching of said first surface of said semiconductor substrate further comprises anisotropically etching with a reactive ion etch.

34. The method in accordance with claim 30 wherein said etching of said first surface of said semiconductor substrate further comprises isotropically etching with a high frequency nitric chemistry technique.

35. The method in accordance with claim 30 further comprising the steps of:

applying a layer of adhesive material onto said second surface; and applying a layer of metal on said layer of adhesive material.

36. The method in accordance with claim 35, further comprising the steps of:

patterning said second surface to selectively place said layer adhesive material; and patterning said second surface to selectively place said layer of metal.

37. The method in accordance with claim 35 wherein said step of depositing a layer of adhesive material further comprises depositing a layer of tantalum 100 to 500 angstroms thick.

38. The method in accordance with claim 35 wherein said step of depositing a layer of metal further comprises depositing a layer of metal 1 to 2 microns thick.

39. The method in accordance with claim 35 wherein said step of depositing a layer of metal further comprises depositing a layer of inert metal from the group consisting of gold, palladium and platinum.

40. A method for creating an integrated heat-sink for a printhead from a semiconductor substrate with a first surface and a second surface, comprising the steps of:

growing a layer of silicon dioxide on said first surface of said semiconductor substrate;

masking said layer of silicon dioxide thereby creating a masked area;

etching said layer of silicon dioxide thereby exposing said masked area on said first surface of said semiconductor substrate;

applying a layer of thermally-conductive material in said masked area;

applying a layer of phosphosilicate glass (PSG) on said silicon dioxide layer and said masked area;

processing said semiconductor substrate with thin-film layers thereby creating a stack of thin-film layers; and applying an orifice layer on said stack of thin-film layers.

41. A head for ejecting fluid having an integrated heat-sink produced in accordance with the method of claim 40.

42. The method associated with claim 40 wherein the stack of thin-film layers created further comprise said layer of grown, masked, and etched silicon dioxide, said layer of PSG, an energy dissipating element, and a fluid feed slot, the method further comprising the steps of:

etching said orifice layer thereby creating a plurality of orifices positioned in association with said energy dissipating element and said fluid feed slot; and etching a fluid feed channel in said second surface of said semiconductor substrate thereby exposing said fluid feed slot and a first portion of said layer of thermally-conductive material whereby a second portion of said layer of thermally conductive material extends over said first surface of said semiconductor substrate.

43. A fluid cartridge for ejecting fluid onto a recording medium, comprising:

a printhead with an integrated heat-sink for ejecting fluid, further comprising, a semiconductor substrate having a first surface and a second surface, a stack of thin-film layers disposed on said first surface of said semiconductor substrate, a fluid feed slot disposed within said stack of thin-film layers, a fluid feed channel disposed within said second surface of said semiconductor substrate and extending to said first surface of said semiconductor substrate, and said fluid feed slot opening into said fluid feed channel, and said integrated heat-sink attached to said stack of thin-film layers within said fluid feed channel on said second surface of said semiconductor substrate;

a container for holding a quantity of fluid; and a fluid delivery assemblage whereby the conveyance of said quantity of fluid to said fluid feed channel for ejecting fluid is regulated.

44. An apparatus for placing fluid onto a medium, comprising:

a fluid cartridge for ejecting fluid onto a recording medium, further comprising, a printhead with an integrated heat-sink for ejecting fluid, further comprising, a semiconductor substrate having a first surface and a second surface, a stack of thin-film layers disposed on said first surface of said semiconductor substrate, a fluid feed slot disposed within said stack of thin-film layers, a fluid feed channel disposed within said second surface of said semiconductor substrate and extending to said first surface of said semiconductor substrate, and said fluid feed slot opening into said fluid feed channel, and said integrated heat-sink attached to said stack of thin-film layers within said fluid feed channel on said second surface of said semiconductor substrate;

a container for holding a quantity of fluid, and a fluid delivery assemblage whereby the conveyance of said quantity of fluid to said fluid feed channel for ejecting fluid is regulated; and a conveyance assemblage for transporting said medium on which recording is effected by said fluid cartridge.

* * * * *